US005464210A

United States Patent [19]

Davis et al.

[11] Patent Number: 5,464,210

[45] Date of Patent: Nov. 7, 1995

[54] LONG TENNIS RACQUET

[75] Inventors: Stephen J. Davis, Washington Crossing; André Terzaghi, Havertown, both of Pa.

[73] Assignee: Prince Sports Group, Inc., Bordentown, N.J.

[21] Appl. No.: 295,300

[22] Filed: Aug. 24, 1994

[51] Int. Cl.[6] ..... A63B 49/02; A63B 49/08

[52] U.S. Cl. ..... 273/73 C; 273/733

[58] Field of Search ..... 273/73 R, 73 A, 273/73 B, 73 C, 73 D, 73 J

[56] References Cited

U.S. PATENT DOCUMENTS

| | | | |
|---|---|---|---|
| 3,515,386 | 6/1970 | Mason . | |
| 3,833,219 | 9/1974 | Dean . | |
| 3,999,756 | 12/1976 | Head | 273/73 D |
| 4,399,993 | 8/1983 | Melon . | |
| 4,505,480 | 3/1985 | Vanhoutte | 273/73 C |
| 4,641,838 | 2/1987 | Gabrielidis . | |
| 4,671,511 | 6/1987 | Trysinsky . | |

FOREIGN PATENT DOCUMENTS 2717 of 1909 United Kingdom .

*Primary Examiner*—William E. Stoll
*Attorney, Agent, or Firm*—White & Case

[57] ABSTRACT

A tennis racquet has an overall length greater than 28 inches, preferably between 29 and 32 inches, an egg shape strung surface having a length of at least 14 inches, and a strung surface area greater than 95 square inches. The frame is of widebody construction and formed of a composite material so as to have a minimum weight per unit length. While the overall length is increased, the strung weight of the racquet does not exceed 300 grams, and the mass moment of inertia about the butt does not exceed 56 g-m $^2$. The foregoing racquet produces a number of playing advantages, while maintaining a conventional mass moment of inertia about the handle and thus retain good maneuverability.

10 Claims, 7 Drawing Sheets

| RACQUET MODEL | RACQUET WEIGHT (gm) | BALANCE (cm) | LENGTH (cm) | W/L (g/m) | MMOI (CG) (g-m$^2$) | MMOI (Butt) g-m$^2$ | MOI Butt / L g-m | MOI (5cm) g-m$^2$ | MOI (10cm) g-m$^2$ | COP (Butt) (cm) | COP/W cm/g |
|---|---|---|---|---|---|---|---|---|---|---|---|
| WILSON HAMMER | 287.8 | 38.9 | 68.6 | 419.8 | 11.6 | 55.2 | 80.5 | 67.1 | 80.5 | 49.3 | .171 |
| WILSON SLEDGE HAMMER | 263.0 | 39.9 | 68.6 | 383.4 | 11.2 | 53.1 | 77.4 | 64.3 | 76.7 | 50.6 | .192 |
| PRINCE LIGHT I (MIDSIZE) | 283.2 | 36.5 | 68.6 | 412.8 | 12.6 | 50.3 | 73.3 | 61.3 | 73.8 | 48.7 | .172 |
| PRINCE SYNERGY EXTENDER | 293.6 | 36.9 | 68.6 | 428.0 | 13.7 | 53.7 | 78.3 | 65.3 | 78.3 | 49.6 | .169 |
| GRAPHITE OS | 356.4 | 31.8 | 68.6 | 519.5 | 16.7 | 52.7 | 76.8 | 64.9 | 78.9 | 46.3 | .130 |
| WEED 3/4 (125 SQ. IN.) | 342.4 | 31.8 | 68.1 | | 17.1 | 51.7 | 75.9 | 63.4 | 76.9 | 51.4 | .150 |
| MATCH MATE | 339.4 | 33.9 | 71.8 | 472.7 | 17.1 | 56.1 | 78.1 | 68.5 | 82.5 | 48.8 | .144 |
| THE RAY | 405.0 | 38.2 | 81.3 | 496.2 | 24.2 | 83.3 | 102.5 | 99.8 | 118.3 | 61.5 | .152 |
| KNEISSL REACH PRO COMP PROFILE | 316.4 | 34.5 | 71.4 | 443.1 | 14.8 | 52.5 | 73.5 | 64.2 | 77.5 | 53.6 | .169 |
| KNEISSL REACH PRO CONTROL PROFILE | 319.4 | 34.4 | 71.2 | 448.6 | 14.9 | 52.7 | 74.0 | 64.5 | 77.9 | 52.9 | .166 |
| PRINCE GRAPHITE OS (M. CHANG) | 345.9 | 31.6 | 71.0 | 487.2 | 16.8 | 51.3 | 72.3 | 63.1 | 76.6 | 54.2 | .157 |
| EXAMPLE 1 | 250.9 | 39.0 | 73.6 | 340.9 | 14.3 | 52.5 | 71.3 | 62.9 | 74.6 | 53.3 | .212 |
| EXAMPLE 2 | 249.3 | 40.0 | 73.5 | 339.2 | 12.9 | 52.8 | 71.8 | 63.4 | 75.2 | 53.2 | .213 |
| EXAMPLE 3 | 256.6 | 40.0 | 73.7 | 348.2 | 14.1 | 55.2 | 74.9 | 66.1 | 78.3 | 53.8 | .210 |
| EXAMPLE 4 | 266.5 | 39.5 | 73.7 | 361.6 | 13.6 | 55.2 | 74.9 | 66.4 | 78.9 | 52.4 | .197 |

FIG. 12

| RACQUET MODEL | WEIGHT (g) | BALANCE (cm) | LENGTH (cm) | NODE LOCATION FROM BUTT (cm) | NODE LOCATION FROM TIP (cm) | STRING BED LENGTH (cm) | NODE (BUTT)/W cm/g | NODE STRING (TIP) BED LENGTH cm/g |
|---|---|---|---|---|---|---|---|---|
| WILSON HAMMER | 287.8 | 38.9 | 68.6 | 52 | 15.5 | 34.5 | 0.181 | 0.449 |
| WILSON SLEDGE HAMMER | 263.0 | 39.9 | 68.6 | 52.9 | 14.6 | 34.5 | 0.201 | 0.423 |
| PRINCE LITE I MP | 283.2 | 36.5 | 68.6 | 52 | 15.5 | 51.5 | 0.184 | 0.478 |
| PRINCE SYNERGY EXTENDER | 293.6 | 36.9 | 68.6 | 52.7 | 14.8 | 37.8 | 0.179 | 0.392 |
| PRINCE TC28C 116 | | | 68.6 | 53 | 14.5 | 37.8 | 0.179 | 0.389 |
| PRINCE GRAPHITE OS | 356.4 | 31.8 | 68.6 | 52.7 | 14.8 | 33.7 | 0.148 | 0.442 |
| WEED 3/4 (125 SQ. IN.) | 342.4 | 31.8 | 68.1 | 51.4 | 16.1 | 38.9 | 0.15 | 0.401 |
| MATCH MATE | 339.4 | 33.9 | 71.8 | 55.3 | 15.4 | 34.3 | 0.163 | 0.449 |
| THE RAY | 405.0 | 38.2 | 81.3 | 61.5 | 18.7 | 32.8 | 0.152 | 0.57 |
| KNEISSL REACH PRO COMP PROFILE | 316.4 | 34.5 | 71.4 | 53.6 | 16.7 | 35.2 | 0.169 | 0.474 |
| KNEISSL REACH PRO CONTROL PROFILE | 319.4 | 34.4 | 71.2 | 52.9 | 17.2 | 35.9 | 0.166 | 0.479 |
| PRINCE GRAPHITE OS (M. CHANG) | 345.9 | 31.6 | 71.0 | 54.2 | 15.7 | 33.7 | 0.157 | 0.466 |
| EXAMPLE 1 | 250.9 | 39.0 | 73.6 | 57.5 | 14.8 | 35.9 | 0.23 | 0.412 |
| EXAMPLE 2 | 249.3 | 40.0 | 73.5 | 56.5 | 15.4 | 37.8 | 0.227 | .407 |
| EXAMPLE 3 | 256.6 | 40.0 | 73.7 | 57.1 | 15.5 | 39.1 | .233 | .396 |
| EXAMPLE 4 | 266.5 | 39.5 | 73.7 | 56.3 | 16.3 | 39.1 | 0.211 | 0.417 |

FIG. 13

LONG TENNIS RACQUET

BACKGROUND OF THE INVENTION

Tennis racquets have traditionally had an overall length between 26 and 28 inches, and presently most racquets are approximately 27 inches in length. It is not entirely clear why 27 inches became the industry standard, but it appears that 27 inches is an appropriate length to make a maneuverable yet stable tennis racquet.

British patent No. 2717 (1909) and U.S. Pat. No. 4,399,993, propose making tennis racquets with lengths longer than 27 inches. However, the reason for increasing the length is to allow the racquet to be held and swung with both hands. Such a racquet would tend to be unwieldy and unmanueverable, and a racquet that requires two hands to swing would not be well suited for today's game of tennis, which requires quick reflexes and racquet head movement to hit hard shots and serves.

To the contrary, U.S. Pat. No. 3,515,386, suggests that, if anything, the traditional 27 inch racquet should be shortened to improve maneuverability, playability, and accuracy in hitting the ball. Thus, the '386 patent discloses that even a 27 inch racquet may be too long, and lack sufficient maneuverability, for many players, and suggests reducing the length of the 27 inch racquet, at least for certain groups of tennis players.

In the last 30 years, there have been significant advances in tennis racquet design and materials. In 1976, the oversize racquet, based on U.S. Pat. No. 3,999,756, was introduced, which made the game much easier to play and popularized tennis to another level. Racquet frame material technology has also evolved, from wood to metal and eventually to composite materials. Since 1980, composite materials, e.g., so called "graphite", have become the dominant material used to make high performance tennis racquets due to their high strength-to-weight ratio, allowing racquets to be made lighter and more maneuverable.

Various racquet companies have tried to introduce racquets which are longer than the conventional 27 inch racquet, but all have failed. The main problem was that by making the racquet longer, it became heavier and less maneuverable. This occurred during an era where racquet companies were making, and players were demanding, racquets which were lighter and more maneuverable.

SUMMARY OF THE INVENTION

The present invention is a tennis racquet which maintains the swing weight of modern day lightweight racquets, but which has an overall length substantially longer than present day racquets, i.e., greater than 28 inches, and preferably between 29 and 32 inches.

More particularly, a tennis racquet according to the present invention has an overall length greater than 28 inches and comprises a widebody frame, a single shaft or dual shafts, and a lightweight handle portion, preferably a molded-in handle. The head portion defines an egg shape strung surface having a length of at least 14 inches, and preferably between 14 and 15½ inches and a strung surface area greater than 95 square inches, preferably between 100 and 125 square inches. The frame is formed of a composite material, and is given a widebody profile, so as to have a minimum weight per unit length. The lightweight frame, together with the molded-in racquet handle, are utilized to keep the strung weight of the racquet to 300 grams or less, and so as to maintain a mass moment of inertia about the handle which is no greater than in a conventional racquet, and in particular no more than 56 g-m$^2$.

A racquet having the foregoing structure has a longer length, yet by maintaining the swing weight equal to or less than conventional racquets, the racquet retains good maneuverability. The egg shape frame in the racquet according to the invention, which is the subject of commonly owned U.S. application No. 07/922,930, is structurally the most efficient head shape developed for tennis racquets. Such shape allows the racquet weight to be reduced while maintaining good power and control. The molded-in handle, and where used the monoshaft construction, allow significant additional reductions in weight. By using such a structure and thus reducing racquet weight along the frame, the length of the racquet can be extended while maintaining the same swing weight as in conventional racquets. The longer racquet has a number of playing advantages, discussed below.

A racquet according to the present invention allows a player a greater reach. For example, a racquet which is 2 inches longer than the conventional 27 inch racquet will provide a player with 13% better court coverage. This is calculated by using the volumetric equation of a sphere, $V=\frac{4}{3}\pi r^3$, where "r" is the distance from the shoulder to the tip of the racquet. For a person who is 6 feet tall, r≈4 feet, and the volume of court coverage (standing still) is 268 ft$^3$. A 2 inch longer racquet provides 303 ft$^3$ coverage, or 13% more. This difference is increased as player height decreases. For example, a person who is 5'6" tall would obtain a 14% increase in court coverage. This extra court coverage offers a player tremendous advantage particularly when stretching for a wide volley or returning a wide serve. It can also mean the difference between hitting the ball in the tip of the racquet (which is a traditional low power area) and hitting the ball nearer to the center of the racquet face which is a much more powerful area and therefore a much more solid shot. Players do not have to bend their knees as much, so for older players it will make the game easier to play.

The longer length of the racquet will provide the player more power given the same stroke speed. The tangential velocity of the racquet at the impact area is directly proportional to racquet length, assuming the rotational swing speed is held constant. Assuming ball contact is 6 inches from the tip of the racquet, a 2 inch longer racquet will generate 10% more racquet head speed, and therefore 10% greater ball velocity. This means a player can use more controlled strokes and be effective with similar power or use the same strokes and have even more power.

A longer length racquet provides a higher probability that more serves shall land in play. A 2 inch longer racquet can open up 13% more available area in the service box for an average height player hitting a strong serve. This is calculated by determining the angle formed by the initial trajectory angle from the point of ball contact for a serve that just clears the net and the initial trajectory angle from the point of ball contact for a serve that lands just inside the service box. The angle formed between these two lines is the angle window for the serve and this increases as the contact point height increases. Hitting a ball 2 inches higher increase the serve angle window by 13%. This is a tremendous advantage considering that the serve is the most important stroke in tennis.

Preferably, the racquet employs staggered stringing, in which the ends of the strings are splayed so as to diverge alternately in opposite directions away from the central stringing plane. The use of staggered stringing, particularly in conjunction with an egg shaped head, further helps to provide good control in spite of the additional length of the racquet. Also, by staggering the string holes, the loss of frame strength caused by forming holes in the frame is reduced compared to conventional stringing hole patterns. This allows the frame to be made lighter than a conventional frame having comparable strength.

For a better understanding of the invention, reference is made to the following detailed description of a preferred embodiment, taken in conjunction with the drawings accompanying the application.

BRIEF DESCRIPTION OF THE DRAWINGS

FIGS. 12–13 are tables comparing various properties of racquets made according to the invention against conventional racquets.

DETAILED DESCRIPTION OF A PREFERRED EMBODIMENT

Figure 1:
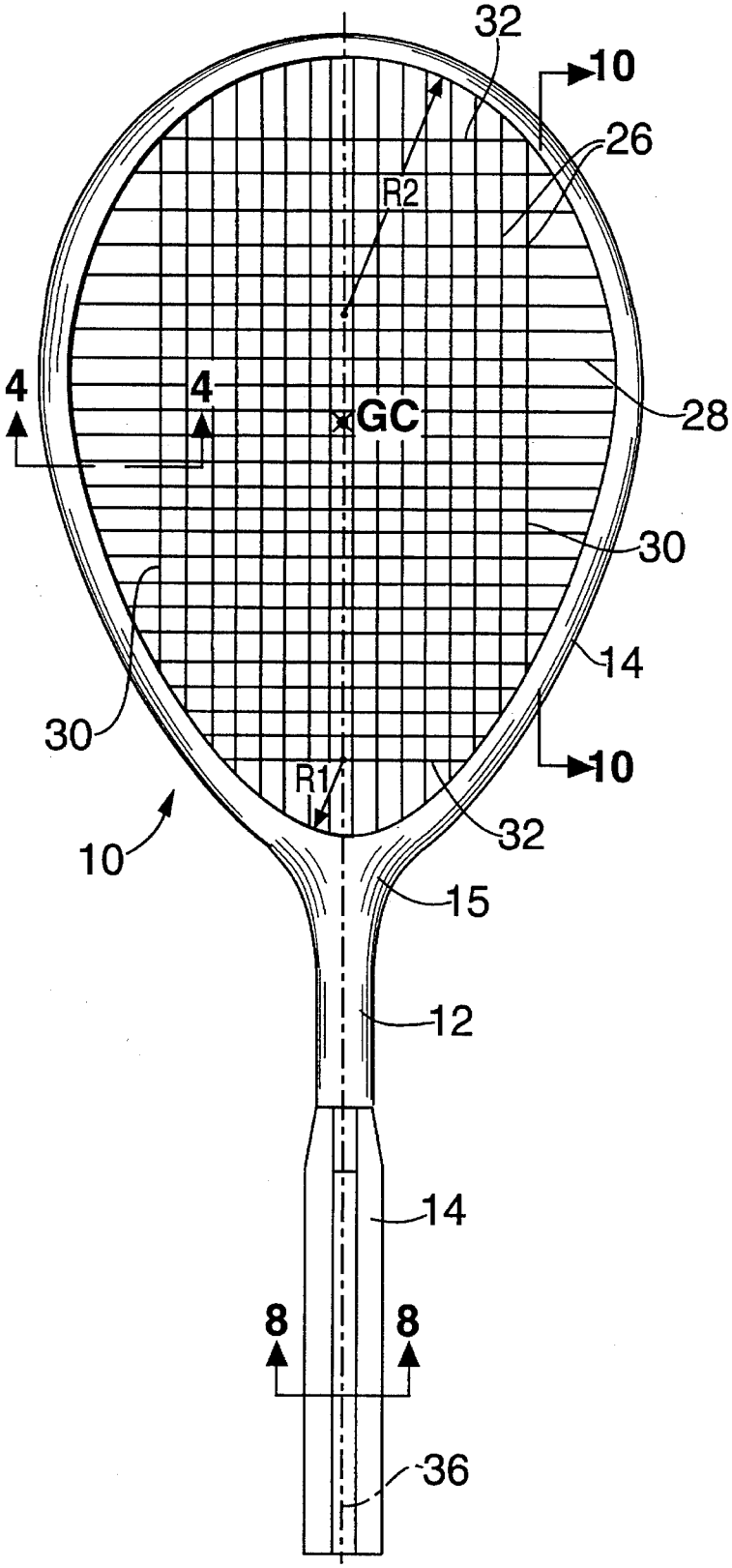
FIGS. 1 and 2 are front and side views of a tennis racquet according to the invention.
Figure 2:
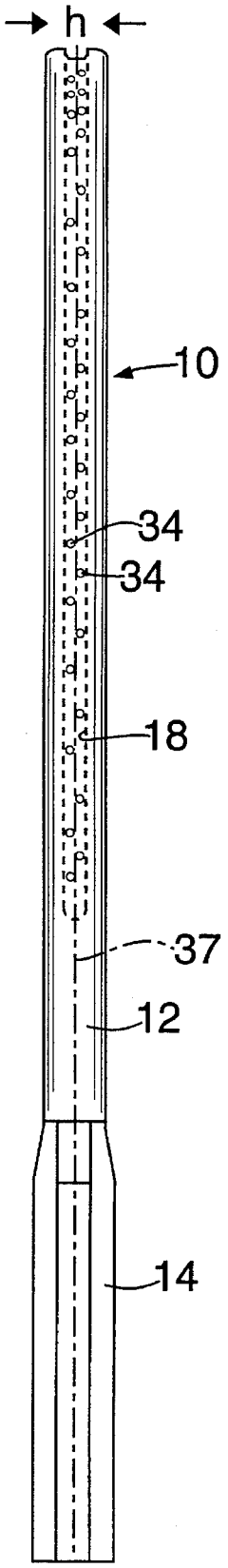

Referring to FIGS. 1–2, a tennis racquet according to the invention includes a head 10 and a shaft 12, which are connected together at a throat joint 15. The shaft 12 includes a handle section 14. The racquet further includes a plurality of interwoven main 26 and cross 28 strings forming a strung surface. Also, a stringing groove 18 is formed in the outwardly facing surface in the conventional manner.

The head 10 and shaft 12 may be formed as either separate layups or as one, continuous frame member. Preferably, the head and shaft are in the form of hollow tubular members, composed of composite materials. Examples of suitable materials include carbon fiber-reinforced thermoset resin, i.e., so-called "graphite", or a fiber-reinforced thermoplastic resin such as disclosed in commonly owned U.S. Pat. No. 5,176,868.

A tennis racquet according to the invention is longer than conventional tennis racquets, preferably having an overall length between 29 and 32 inches. Despite its longer length, a racquet according to the present invention retains a moment of inertia comparable to conventional racquets, thus avoiding the drawbacks of prior longer racquets. To the contrary, a racquet according to the invention produces a marked improvement in playability, by incorporating certain characteristic structural features, as follows:

(a) the head 10 is egg-shaped rather than a conventional oval shape, and has a strung surface length longer than conventional racquets;

(b) the frame profile utilizes a widebody construction for optimum strength-to-weight ratio; and (c) the handle is lightweight, preferably a so-called "molded-in" handle, i.e., is molded directly into the shape of an octagonal handle.

In one embodiment of the invention, the head 10 is connected to the handle 14 by a hollow monoshaft 12, further reducing the weight of the racquet. In an alternative embodiment (FIG. 11), the head 10*a* is connected to the handle 14 using a pair of spaced shafts 12*a*.

A racquet according to the present invention may also utilize staggered strings. An exemplary embodiment of a racquet having the foregoing structure is described below in connection with FIGS. 1–10.

Egg Head Shape

The head portion 10 defines an egg shape stringing area 22 in which the smaller end of the "egg" faces the shaft 12. As used herein, the term "egg-shape" refers to a geometry wherein the border of the stringing area is a continuous convex curve, formed of a multitude of radii; wherein the radius of curvature at the six o'clock position (the end of the stringing area closest to the handle) is between 30 and 90 mm; wherein the radius at the 12:00 o'clock position (tip) is greater than 110 mm, preferably between 110 and 170 mm; wherein the stringing area has an aspect ratio (ratio of length/width) in the range of 1.3–1.7, and most preferably about 1.4; and wherein the widest point of the strung surface is located at a point greater than 5% of the distance from the geometric center of the strung surface (the mid-point of the long axis of the strung surface) toward the tip, and most preferably about 25–30 mm from the geometric center toward the tip.

In addition to having an egg shape geometry, the frame is sized so that the major axis of the egg (length of the stringing surface) is at least 14 inches, and most preferably between 14 inches and 15½ inches. The maximum width of the stringing surface is less than 10.75 inches, and the overall string plane area defined by the egg is between 95 $in^2$ and 125 $in^2$.

Monoshaft and Molded-In Handle

In FIG. 1, the racquet has a monoshaft 12 which is connected to the head 10 by a throat joint 15. An example of a throat joint 15 and monoshaft 12 is shown in greater detail in FIGS. 3 and 7.

Figure 3:
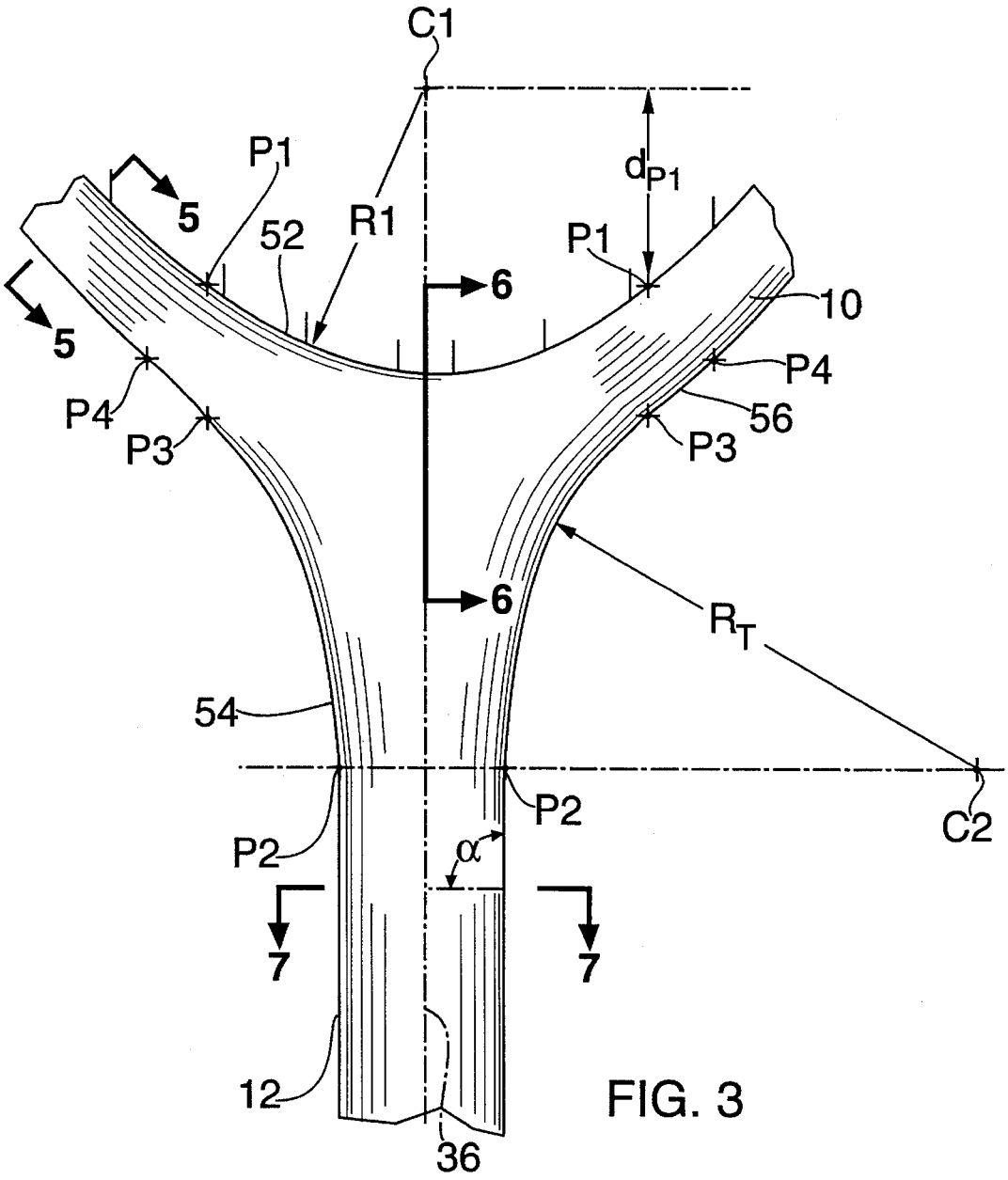
FIG. 3 is an enlarged front view of the throat joint of a preferred embodiment of the invention.

As shown in FIG. 3, preferably the sides of the shaft are slightly tapered, at angle $\alpha$, from the throat joint 15 to the handle portion 14. In an exemplary embodiment, $\alpha$ is 90.1°, and the cross sectional width of the shaft decreases from 28.4 mm at the throat joint 15 (the point P2—P2) to 25 mm at the top of the handle portion 15, while the cross sectional height "h" remains constant at 25 mm.

The throat joint 15, which joins the monoshaft 12 to the head 10, preferably includes a minimum amount of material and thereby weight. In the throat region, the inner frame surface 52, which forms the bottom of the strung surface area 22, is defined by an arc having a radius R1 about a center C1 lying on the racquet axis 36. The radius R1 is the minimum radius for the egg shape head. The inner frame surface 52 extends between points P1 that lie on opposite sides of the axis 36 at an axial distance "$d_{P1}$" from the center C1.

The outer surface of the joint 15 is formed of a shaft transition region 54, adjoining the upper end of the shaft 12, and a head transition region 56, adjoining the opposite ends of the head 10. The shaft transition region 54 begins at points P2, as an extension of shaft 12, and thus points P2 are spaced apart the width of the shaft. The shaft transition region 54 is defined by an arc having a radius $R_T$ about a center C2, which lies at approximately the same axial distance as points P2. The shaft transition region extends to points P3. In the head transition region 56, the outer surface of the joint follows a curve, such that the cross-sectional width decreases until, at point P4 (where the head begins), the width is the same as the head portion 10.

The handle 14 has a conventional octagonal cross-sectional shape. The handle is a so-called "molded-in" handle, such as that used in the Prince Lite racquet, in which the composite frame member is molded directly into the shape of the handle, rather than attaching a separate handle on the shaft. Because the molded-in handle is hollow, the weight of the handle is minimized. The handle 14 is normally wrapped with a grip (not shown).

Examples of processes that may be used to form a monoshaft racquet and throat joint 15 are disclosed in commonly owned U.S. patent application No. 07/988,579, the relevant portions of which are incorporated herein by reference. An example of a process that may be used to make the racquet is described below. Because molding techniques in general for making a composite tennis racquet are well known in the art, the process will be described only briefly.

Figure 9:
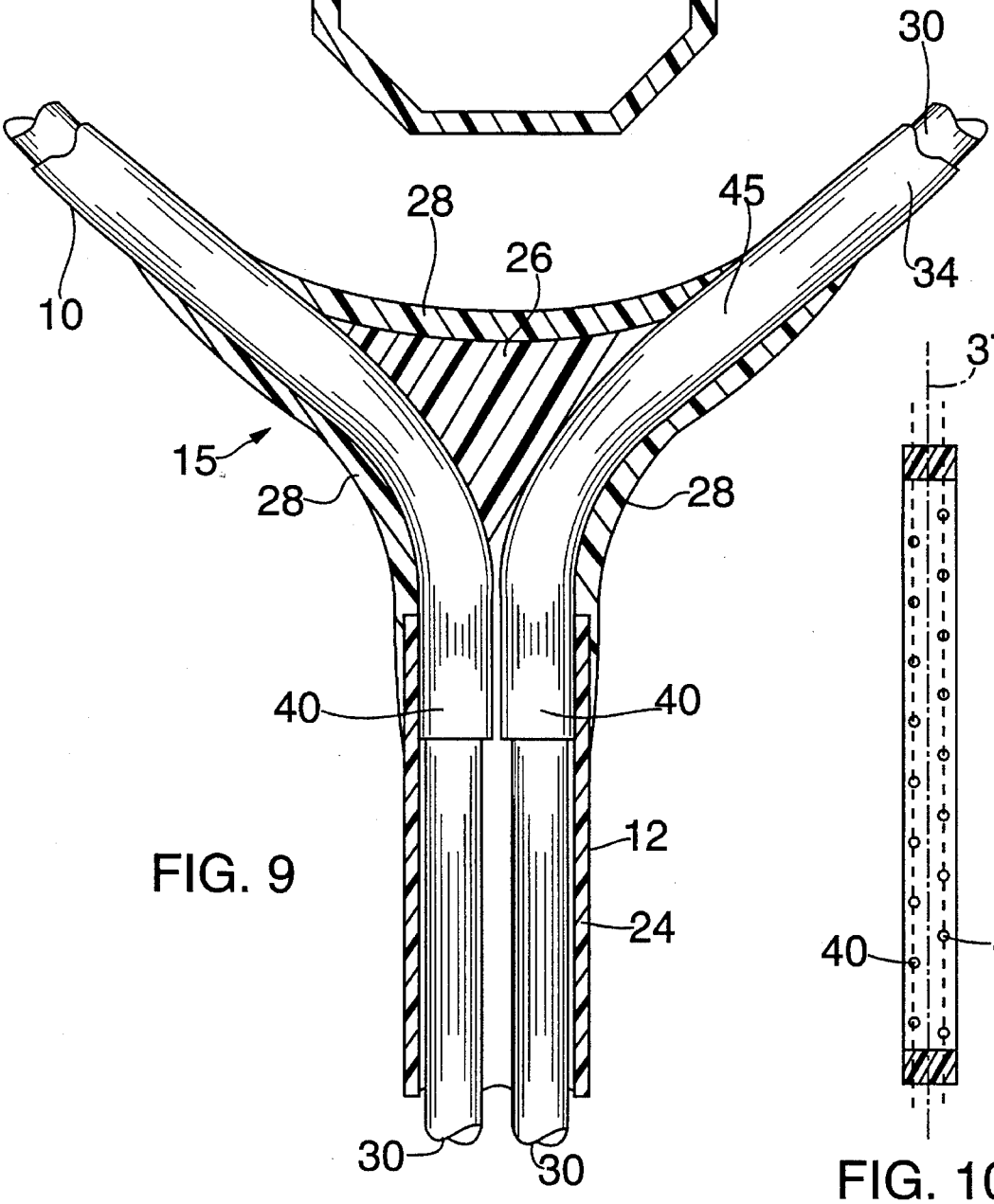
FIG. 9 is a front, sectional view of a layup of the throat region, prior to molding, of the racquet of FIG. 1.

Referring to FIG. 9, a tubular layup 24 having a length corresponding to handle 14 and shaft 12 is formed of sheets of uncured fiber-reinforced, thermosetting resin (prepreg) in the normal manner. A second tubular layup 34, having sufficient length to form the head portion 10, is formed in a similar manner. The tubes are packed into a mold in the shape of a tennis racquet, so that the ends 40 of the head layup 34 extend for a short distance into the upper end of tube 24. In order to form the throat joint 15, additional uncured composite material 26 is packed in the throat area 15, and the throat joint 15 is wrapped by additional sheets of composite prepreg 28. A bladder 30 is directed up through the shaft layup 24, around the head layup 34, and then back down the other side of the shaft layup, such that the two ends of the bladder extend out the bottom of the handle 14.

The mold is then closed and the bladder 30 is inflated to force the composite material to assume the shape of the mold. Simultaneously, the mold is heated so that the composite resin cures and hardens. In order to make a molded-in handle, the portion of the mold (not shown) forming the handle 14 has an internal surface matching the octagonal shape of the handle 14 of FIG. 8.

FIG. 9 illustrates a preferred embodiment in which the head 10 and shaft 12 are separate elements. The head 10 and shaft 12 be either the same material or different materials. Also, rather than providing prepreg layups, the head 10 and shaft 12 may be provided as pre-formed components. Where the head and shaft are pre-formed components, it is necessary to mold and cure only the throat joint area to complete the frame.

As shown in FIG. 9, the two opposite ends 40 of the head 10 are bent so as to extend side-by-side for a predetermined distance along the center axis of the head 10. The ends 40 of the head 10 are inserted into the upper end of the shaft 12 to form, with material 26 and 28, a secure joint between the head and shaft.

As shown for example in FIG. 9, the throat joint 15 includes a relatively sharp bend between the shaft 12 and head 10. As a result, the initial section 45 of shaft 10 extends at about an angle of about 125° relative to the shaft axis 36. Moving further up the head 10, this angle becomes less. However, over its initial length, the head 10 profile members carry out of plane bending loads mostly as torsion. As a result, in a preferred embodiment of the invention, the bias angle of the fibers in the prepreg used to form frame section 45, and for a desired additional distance along the head 10, is increased in order to improve the torsional stiffness of the initial portion of the frame. Additionally, or alternatively, the reinforcement 28 is wrapped such that the reinforcement fibers are at a bias angle to increase torsional stiffness.

In an alternative embodiment, the head 10 and shaft 12 can be formed from a continuous tubular layup. In such a case, the shaft 12 and handle 14 will be formed by extending the ends of the tubes forming the head portion 10. The throat area 15 will be formed in a manner similar to FIG. 9, with reinforcing material 26 and 28 used to form a secure joint 15, except that the ends of the tube forming the head extend through the throat area, and thereafter extend side-by-side, below the joint 15, to form the shaft and handle rather than being inserted in a separate shaft tube as in FIG. 9. When molded, a center wall will be formed inside the shaft and handle, where the side-by-side tubes abut. Preferably, to reduce weight, the center wall is cut out after molding.

Widebody Frame

The frame has a "widebody" profile, i.e., has a cross sectional height "h" (in a direction perpendicular to the stringing plane) greater than 22 mm. In the most preferred embodiments, the cross sectional height "h" of the frame profile is between 25 and 26 mm. Also, while in the exemplary embodiment shown in FIGS. 1 and 2, the head 10 and shaft 12 have a constant cross-sectional height "h", and the head 10 has a constant width "w", the height and width of the head portion 10 and shaft 12 can be varied as desired.

Staggered Strings

Figure 10:
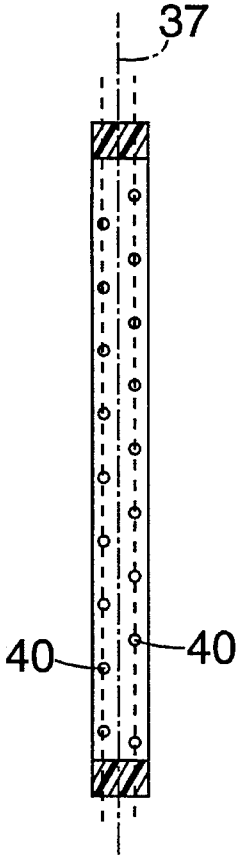
FIG. 10 is a view of the portion of the inside surface of the frame head portion, with the strings omitted for clarity, taken in the direction of lines 10—10 in FIG. 1.

The head portion 10 includes holes 34 for receiving strings. As can be seen in FIGS. 2 and 10, the holes are not located in the central stringing plane 37, but rather are staggered such as to lie alternatively on opposite sides of the plane 37.

Figure 4:
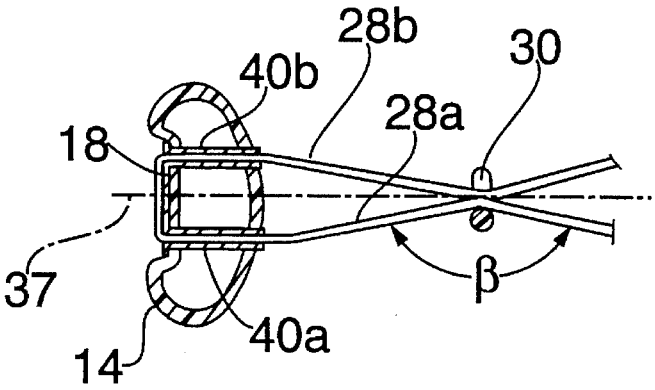
FIG. 4 is a sectional view of the racquet and stringing, taken through lines 4—4 of FIG. 1.

Referring to FIGS. 1 and 4, the main strings 26 include a pair of strings 30 located outermost from the geometric center GC of the strung surface at opposed locations; similarly, the cross strings include a pair of strings 32 located outermost from the geometric center. Each of these outermost strings 30, 32 form the last crossing string of the respective cross or main string before it engages the frame head portion 13.

Referring to FIG. 10, it will be seen that the holes 40 for the cross strings lie alternately on opposite sides of the center plane, so as to produce a staggered string pattern. Preferably, staggered stringing is employed for all of the cross strings 28 and main strings 26. As shown in FIG. 10, preferably the string holes lie at a constant distance from the center stringing plane 37, so as to produce a constant stagger. Alternatively, other staggered stringing patterns could be employed.

Referring to FIG. 4, which illustrates staggered stringing for two successive cross strings **28*a* and 28*b*, the first 28*a* of the two cross strings extends over the outermost main string 30, and is thereafter directed to engage the frame head portion 14, through grommet 40*a*, which extends through a pair of string holes 40*a* formed in the hollow frame, which is located below the central stringing plane 37. As a result, the cross string 28*a* engages the outermost main string 30 at an angle β which is less than 180°. The string 28*a* passes through string hole 40*a* and enters the stringing groove 18, where it crosses the central plane 37 to string hole 40*b*. From string hole 40b, the next cross string 28b extends under the outermost main string 30, and then extends upwardly to engage the next main string (not shown). For purposes of clarity, the angle by which the cross strings 28a, 28b diverge toward the center of the stringing surface (i.e. toward the right in FIG. 4) has been exaggerated slightly in FIG. 4**.

As alternative embodiments to the stringing configuration shown in FIGS. 2–5, a conventional stringing pattern, in which none of the strings are staggered, may be employed, some of the strings may be staggered, while others are not, or the amount of stagger can vary at different locations about the head.

The use of staggered stringing improves the performance of the string bed. Moreover, by staggering the string holes, the distance between adjacent holes is increased compared to conventional string hole patterns (where all the holes are aligned). This means that the loss of strength caused by forming holes in the frame is less than in conventional racquets. As a result, the frame according to the present invention can be made lighter than a conventional frame (i.e., using less material) while retaining the same strength.

Figure 11:
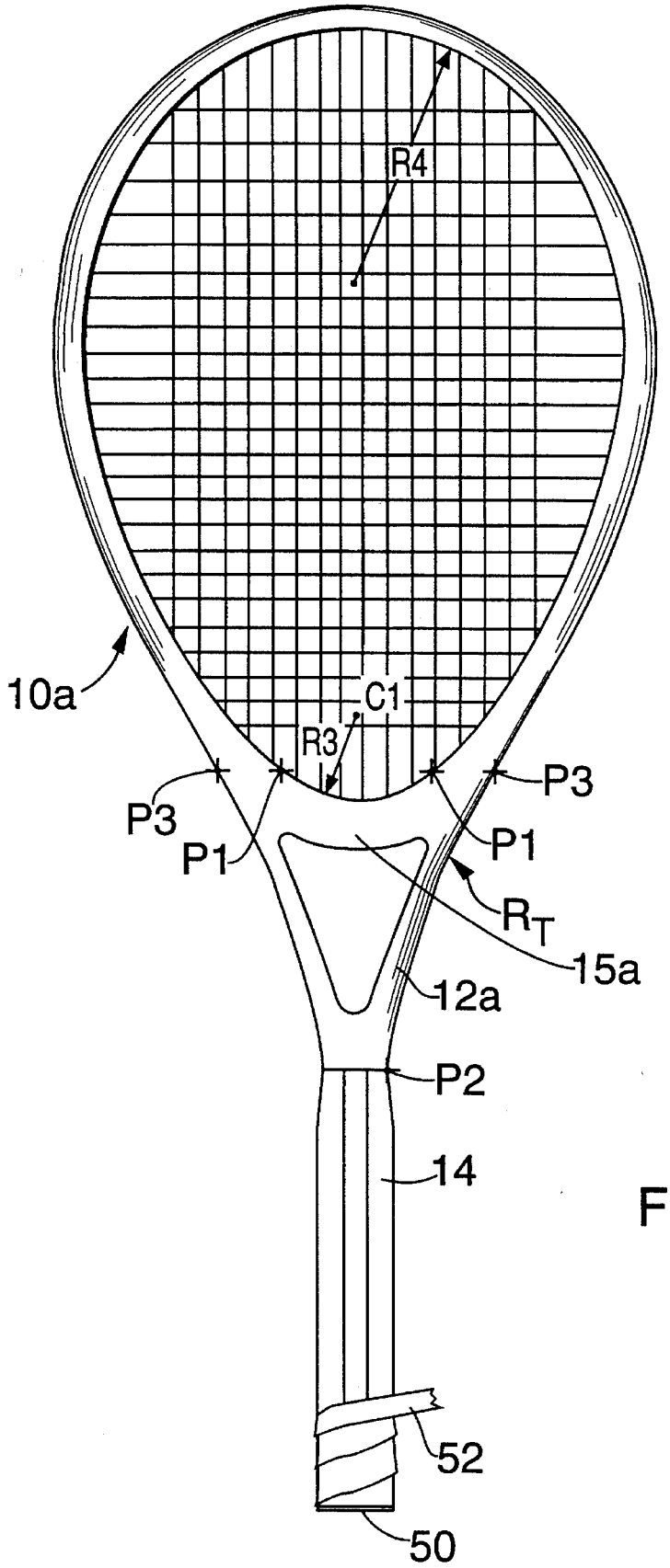
FIG. 11 is a front view of an alternative embodiment of the invention.

FIG. 11 shows an alternative embodiment in which the head 10a is connected to the handle 14 by a pair of converging shaft portions 12a. A throat bridge 15a spans the shaft portions 12a so as to complete the stringing area. However, the head is egg shaped, as in the embodiment of FIG. 1, having a radius R3 at the 6 o'clock position which is smaller than the radius R4 at the 12 o'clock position. From P3 to P2, the frame member follows a curve having a radius $R_T$, and the area between the shafts 12a below the throat bridge 15a is open. As shown in FIG. 11, preferably a butt cap 50 covers the bottom end of the handle 14, and a grip 52 is wrapped around outside of the octagonal shape handle 14 to complete the racquet.

In summary, a racquet according to the invention is greater than 28 inches, preferably between 29 and 32 inches in overall length, utilizes an egg shape frame having a minimum length greater than 14 inches, and a lightweight, preferably molded-in, handle. In conjunction with using a frame having such a shape, the frame should be made relatively lightweight throughout, by using thin wall sections and widebody construction (height greater than 22 mm, and aspect ratios of about 2/1 or higher).

By utilizing the foregoing shapes, with materials available today it is possible to make a racquet weighing substantially less than 300 grams, and most preferably approximately 250 grams, with a longer stringing bed without a trampoline effect, and retaining good power and control. This results in the ability to increase the overall length of the racquet, while retaining the playing advantages of a high performance conventional racquet. The length of the racquet can be increased substantially before the total weight and moment of inertia about the handle reach that of conventional racquets. The racquet thus feels the same as a conventional racquet, but in fact the added length will offer a significant playing advantage.

To further improve the playability of the racquet, the polar moment of inertia (the mass moment of inertia about the longitudinal axis of the racquet) should be less than 1.90 gram-$m^2$, and preferably between 1.6–1.7 gram-$m^2$, and the balance point (center of gravity) should be located at least 13.4 inches from the butt end. As noted above, the strung surface length should be greater than 14 inches, and the frame preferably has a minimum free space frequency of 140 Hz for a composite racquet. Preferably, the cross sectional width of the frame is 12.5 mm.

Figure 5:
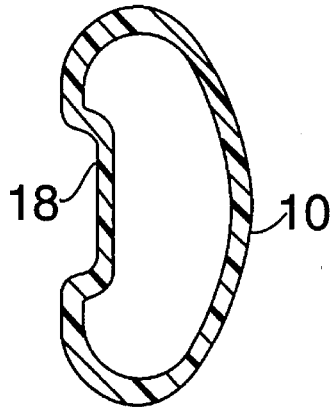
FIG. 5 is a sectional view of the frame, taken through lines 5—5 of FIG. 3.
Figure 6:
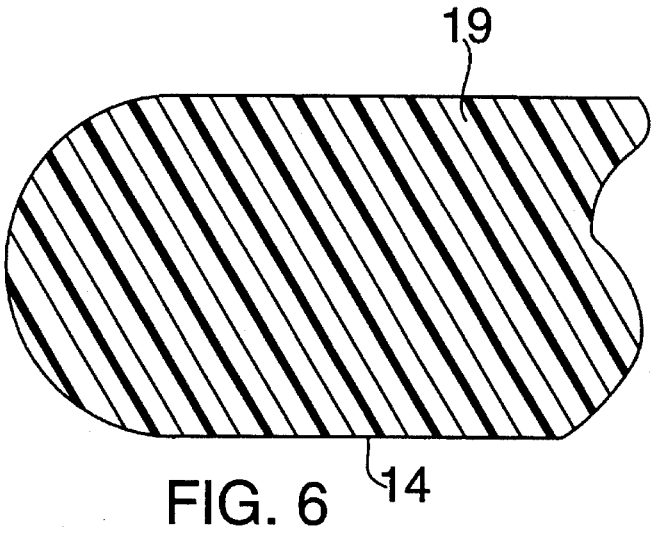
FIG. 6 is a sectional view of the throat joint, taken through lines 6—6 of FIG. 3.
Figure 7:
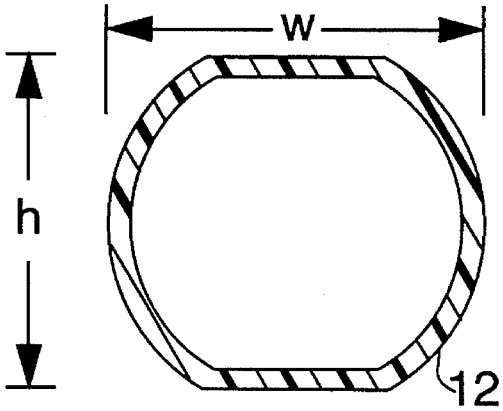
FIG. 7 is a sectional view of the shaft, taken through lines 7—7 of FIG. 3.
Figure 8:
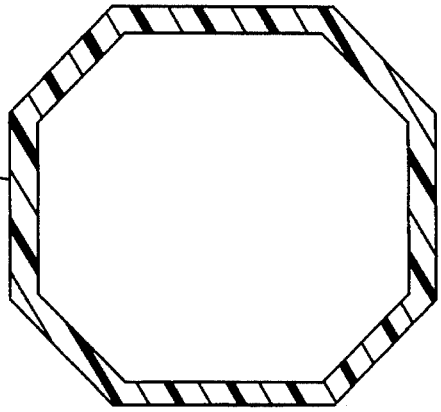
FIG. 8 is a cross-sectional view of the handle, taken through lines 8—8 of FIG. 1.

As shown in FIGS. 5, 7, and 8, the head 10, shaft 12, and handle 14 of the frame are formed of hollow profile members of, e.g., molded composite material. Except in the throat joint, the profile members have minimum wall thickness, preferably of less than 2 mm, to reduce weight. Preferably, the wall thickness at any given location on the frame varies depending upon the bending stress likely to be encountered.

A racquet may be made using a thermoplastic material. Instead of forming the layups of thermosetting resins, sleeves of braided reinforcement fiber and thermoplastic filaments are utilized to form the frame, as disclosed in commonly owned U.S. Pat. No. 5,176,868. Additional commingled fiber/filament material is used as reinforcement 26, 44 and as a wrap 28, 46 for the throat joint 15.

Racquets made according to the invention, and having an overall length of 29 inches, were compared against conventional racquets for various properties, as shown in FIGS. 11–12.

EXAMPLE 1

The racquet of Example 1, which is shown in FIGS. 1–10, had an overall length of 29 inches, a strung surface length of 14.1 inches, a maximum width of 9.8 inches, a frame height "h" of 25 mm, a frame width of 12.5 mm in the head portion 10, a strung surface area of 104 $in^2$, and the following additional structural characteristics, as shown in FIG. 3 (which is drawn to full scale):

| | |
|---|---|
| R1 (6:00 o'clock) | 45 mm |
| R2 (12:00 o'clock) | 118 mm |
| max radius | 323 mm at about the 5 and 7 o'clock positions |
| P1 location (re C1) | 33 mm (i.e., $d_{P1}$) |
| P2 location | 101 mm |
| P3 location | 52 mm |
| P4 location | 43 mm |
| C2 location (re C1) | 103 mm |
| $R_T$ | 75 mm |
| α | 90.1° |
| shaft width (at P2) | 28.4 mm |
| shaft width above handle | 25 mm |
| shaft height | 25 mm |
| distance of widest point from tip | 162.5 mm |

EXAMPLE 2

Example 2 was similar to Example 1, having a monoshaft construction, except the strung surface area was larger:

| | |
|---|---|
| strung surface area | 116 $in^2$ |
| overall length | 29 in. |
| strung surface length | 14.9 inches |
| maximum width | 10.35 in. |
| frame height "h" | 25 mm |
| frame width (head) | 12.5 mm |
| R1 (6:00 o'clock) | 45 mm |
| R2 (12:00 o'clock) | 124 mm |
| max radius | 350 mm at about the 5 and 7 o'clock positions |
| P1 location (re C1) | 32 mm |
| P2 location | 100 mm |
| P3 location | 52 mm |
| P4 location | 40 mm |
| C2 location (re C1) | 103 mm |
| $R_T$ | 75 mm |
| α | 90.1° |
| shaft width (at P2) | 28.4 mm |
| shaft width above handle | 25 mm |
| shaft height | 25 mm |
| distance of widest point from tip | 171 mm |

EXAMPLE 3

Example 3 was similar to Examples 1 and 2, except that it has a larger strung surface area, with the following structure:

| | |
|---|---|
| strung surface area | 125 $in^2$ |
| overall length | 29 in. |
| strung surface length | 15.4 inches |
| maximum width | 10.75 in. |
| frame height "h" | 26 mm |
| frame width (head) | 12.5 mm |
| R1 (6:00 o'clock) | 45 mm |
| R2 (12:00 o'clock) | 133 mm |
| max radius | 500 mm at about the 5 and 7 positions |
| P1 location (re C1) | 32 mm |
| P2 location | 100 mm |
| P3 location | 52 mm |
| P4 location | 40 mm |
| C2 location (re C1) | 103 mm |
| $R_T$ | 75 mm |
| $\alpha$ | 90.1° |
| shaft width (at P2) | 28.4 mm |
| shaft width above handle | 25 mm |
| shaft height | 25 mm |
| distance of widest point from tip | 174 mm |

EXAMPLE 4

Example 4 corresponds to FIG. 11, having a dual shaft construction, with the following structure:

| | |
|---|---|
| strung surface area | 125 $in^2$ |
| overall length | 29 in. |
| strung surface length | 15.35 inches |
| maximum width | 10.75 in. |
| frame height "h" | 26 mm |
| frame width (head) | 12.5 mm |
| R3 (6:00 o'clock) | 55 mm |
| R4 (12:00 o'clock) | 133 mm |
| max radius | 400 mm at about the 5 and 7 positions |
| P1 location (re C1) | 38 mm |
| P2 location | 108 mm |
| P3 location | 32 mm |
| $R_T$ | 380 mm |
| shaft width above handle | 29 mm |
| shaft height | 25 mm |
| distance of widest point from tip | 174 mm |

As shown in FIG. 12, the mass moment of inertia about the butt for racquets made according to the invention is about the same as in conventional racquets. Thus, racquets made according to the invention are longer, yet have swing weights comparable to other racquets. Moreover, comparing points beyond the butt, racquets made according to the invention have lower moments of inertia due to their overall lighter weight. Therefore, such racquets are generally more maneuverable than conventional racquets.

Racquets made according to the invention have generally higher moments of inertia about the center of gravity (the exceptions are the Matchmate and Ray racquets, which are very heavy tennis racquets). Thus, such racquets are more stable for off center hits along the center axis than conventional lighter weight racquets.

Thus, as shown by FIG. 11, a racquet according to the invention is light, yet stable racquet, and thus combines two of the more desirable characteristics of a tennis racquet, maneuverability and stability. In contrast, in conventional racquet designs, there is normally a trade off between these two characteristics.

As further shown in FIG. 11, racquets made according to the invention have the highest center of percussion of any of the racquets tested. As used herein, center of percussion means as measured about the butt end. Moreover, the ratio of center of percussion to weight of the racquet is significantly higher in racquets according to the present invention.

By having the center of percussion so far away from the hand, the racquet has a very playable area between the center of percussion and the throat of the racquet. In general, when balls are hit between the center of percussion and the hand, the shot feels very solid. In contrast, when balls are hit between the center of percussion and the racquet tip, the player usually feels greater shock, and the ball rebounds with lower energy.

In racquets according to the invention, the location of the upper node of vibration is located at a greater distance from the butt than conventional racquets, as shown in FIG. 12 (except for the Ray, which is long and heavy). The node location is thus approximately the same distance from the tip as in conventional racquets. If a conventional frame were simply lengthened, with the head remaining the same size, the node would move towards the butt of the racquet, which places the node lower in the head (reducing the size of the sweet spot). This has been confirmed by measurements made on prior long racquets, where node locations have been significantly further away from the tip of the racquet than conventional racquets using a similar head shape. In the present invention, the location of the upper node of vibration is more than 57% of the length of the string bed away from the handle end.

The foregoing represents preferred embodiments of the invention. Variations and modifications will be apparent to persons skilled in the art, without departing from the inventive concepts disclosed herein. For example, while the head 10 and shaft 12 in the embodiment of FIG. 2 are shown with straight profiles, i.e., constant height "h", varied profiles may be employed. For example, the head 10 and/or shaft 12 may be given a constant taper profile such as disclosed in commonly owned U.S. Pat. No. 5,037,098. In an illustrative embodiment, the frame height varies from 24 mm just above the handle to 34 mm at the tip. However, other dimensions, such as 24 mm at the handle to 30 mm at the tip, may be employed, depending on the desired frame characteristics. Alternatively, the shaft may be given a non-uniform profile. All such modifications and variations are intended to be within the skill of the art, as defined in the following claims.

We claim:

1. A tennis racquet comprising a frame having a head portion forming a strung surface containing strings, a handle, and at least one shaft connecting said head portion and said handle, wherein said head portion defines an egg shape strung surface having a length of at least 14 inches and a strung surface area greater than 95 square inches; wherein said frame is a tubular, widebody profile member formed of a composite material having a minimum weight per unit length; and wherein said racquet has an overall length which is greater than 28 inches but less than such length as would result in a strung weight exceeding 300 grams or a mass moment of inertia about the handle exceeding 56 g-$m^2$.

2. A tennis racquet according to claim 1, wherein said handle comprises a molded-in handle.

3. A tennis racquet according to claim 1, wherein said at least one shaft comprises a single, hollow tubular shaft, and further comprising a throat joint joining said head portion and said shaft.

4. A tennis racquet according to claim 3, wherein said handle comprises a molded-in handle constituting an extension of said shaft.

5. A tennis racquet according to claim 4, wherein said head and shaft are separate elements joined in said throat joint.

6. A tennis racquet according to claim 4, wherein said shaft is substantially rectangular in cross-section, said handle is substantially octagonal in cross-section, and said shaft and handle have hollow interiors with no internal walls.

7. A tennis racquet according to claim 1, wherein said strings are disposed in a central stringing plane, and comprising means for securing ends of said strings to said head portion so that at least some of the string ends are secured alternatively on opposite sides of the center string plane.

8. A tennis racquet according to claim 1, wherein said racquet has an overall length in the range of 29 and 32 inches.

9. A tennis racquet according to claim 1, wherein said strung surface has a radius of curvature between 118 and 133 mm at the tip and between 45 and 55 mm above the throat.

10. A tennis racquet according to claim 1, wherein the strung surface has sufficient length so that the upper node of vibration is more than 57% of the length of the string bed away from the handle end.

* * * * *